United States Patent [19]

Focke

[11] Patent Number: 4,526,360

[45] Date of Patent: Jul. 2, 1985

[54] PROCESS AND APPARATUS FOR FEEDING BANDS TO A PACK

[75] Inventor: Heinz Focke, Verden, Fed. Rep. of Germany

[73] Assignee: Focke & Co., Verden, Fed. Rep. of Germany

[21] Appl. No.: 400,524

[22] Filed: Jul. 21, 1982

[30] Foreign Application Priority Data

Aug. 7, 1981 [DE] Fed. Rep. of Germany ..... 3131268

[51] Int. Cl.[3] ..... B65H 3/52

[52] U.S. Cl. ..... 271/122; 271/82; 271/197; 271/284; 271/310

[58] Field of Search ..... 271/121, 122, 310, 194, 271/196, 197, 82, 283, 284

[56] References Cited

U.S. PATENT DOCUMENTS

| | | | |
|---|---|---|---|
| 1,968,941 | 8/1934 | Hall | 271/284 |
| 2,804,304 | 8/1957 | Taini | 271/284 |
| 4,269,405 | 5/1981 | Mitzel | 271/99 X |

OTHER PUBLICATIONS

IBM Technical Disclosure Bulletin, vol. 14, No. 8, pp. 2414 and 2415, Jan. 1972, "Double Document Separator," J. H. Massey.

*Primary Examiner*—Richard A. Schacher

*Attorney, Agent, or Firm*—Sughrue, Mion, Zinn, Macpeak & Seas

[57] ABSTRACT

A method and apparatus for feeding sheet shaped blanks to an article. The blanks are extracted from a magazine by a blank conveyor at a first point, and, occasionally, more than one blank is erroneously extracted. To ensure that only one blank is conveyed to the article, all but one blank are removed at a second point. In the preferred embodiment, the blank or blanks is or are in such a fashion so as to permit a suction conveyor belt to detach all but one blank from the blank conveyor. Once detached, the erroneously extracted blanks are removed via air suction, and the remaining blank is conveyed to the article at a third point.

12 Claims, 4 Drawing Figures

PROCESS AND APPARATUS FOR FEEDING BANDS TO A PACK

DESCRIPTION

Figure 1:
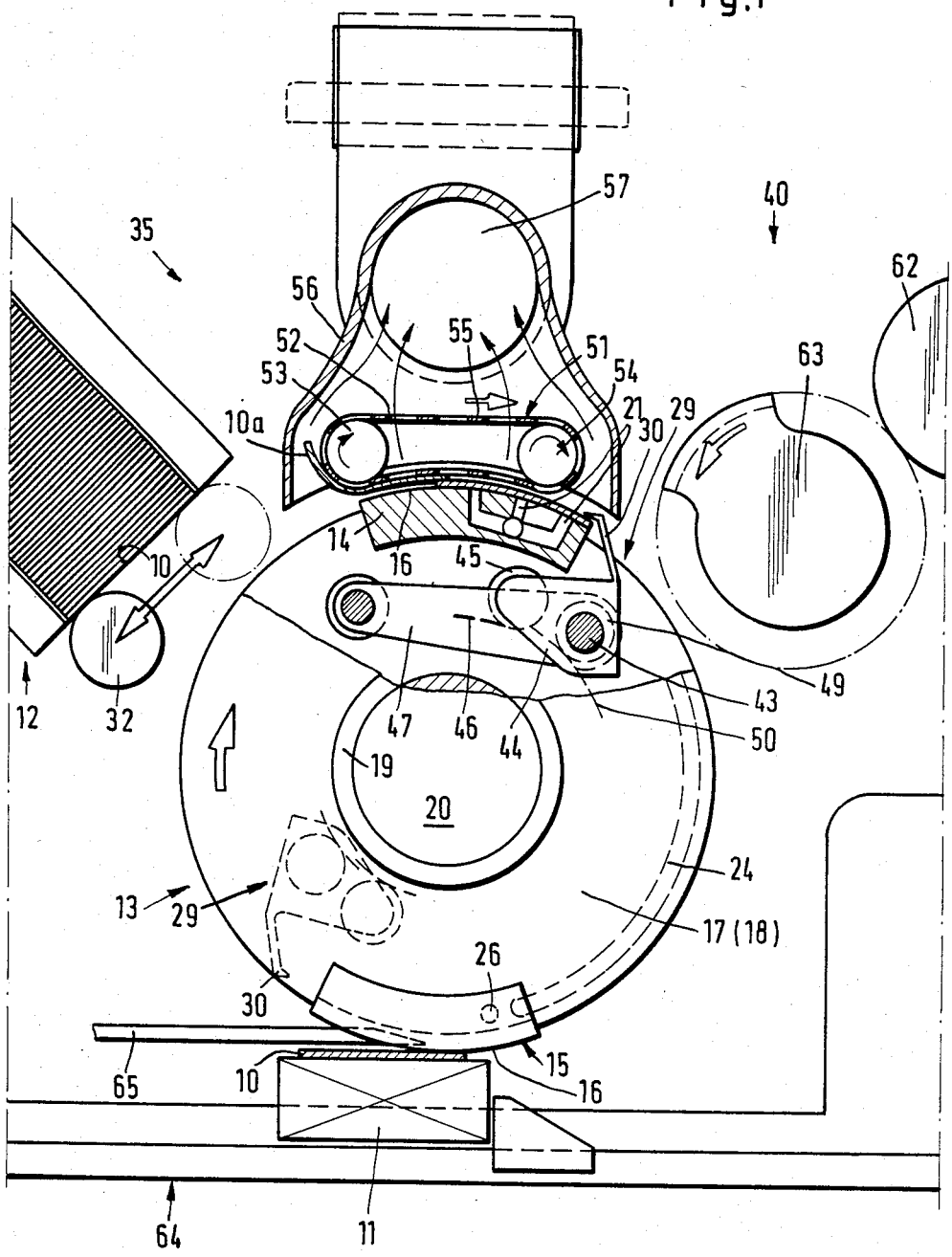

The invention relates to a process for feeding sheet-shaped blanks, especially (revenue) bands, to an article, especially a pack, the bands being extracted from a magazine, being transported by a band-conveyor and being transferred to the pack. Furthermore, the invention relates to an apparatus for carrying out the process mentioned above.

The problem of feeding small thin blanks to a pack and applying them to this arises frequently and in many forms in packaging technology. This subject is especially important in the cigarette industry because it is necessary to attach revenue bands to each cigarette pack. For this application the high efficiency of cigarette packaging machines, which is above average, has to be taken into consideration when the technical problems are solved.

A known apparatus for feeding bands to a (cigarette) pack is equipped with a band-carrier revolving in a circular arc. The particular band extracted from a magazine is held on this by means of suction air and additionally by means of a gripper which engages on the side located at the front in the conveying direction. Before the band is transferred to the pack, this gripper is moved out of engagement and drawn back in such a way that the band can be transferred to the pack by the band-conveyor without damage caused by the gripper. During the transport movement of the band-conveyor, the band is provided with glue on the radially outer side (German Patent Specification No. 1,206,785).

In this apparatus, there is no mention of a special problem with which the invention is concerned. The bands are accommodated in relatively large stacks in a magazine from which they are to be extracted individually. In practise, however, it is not possible to prevent several bands from clinging together within the stack, specifically mainly as a result of the stamping operation. Because of this, several bands adhering to one another are all too often extracted from the magazine at the same time and fed to the pack. During this time, the outer incorrect bands are frequently lost during transport because they become detached from the inner band held against the band-conveyor by means of suction air. This occurs, above all, after the glue has been coated on, when, particularly in the known apparatus the gripper is moved out of engagement.

The incorrect bands which drop off are extremely troublesome in many respects. On the one hand, the (single) band present on the band-conveyor during transfer to the pack is without any glue. On the other hand, the incorrect bands, the outer one being glued, which drop off in a disorderly fashion constitute a considerable obstruction to the operation of the packaging machine.

The object on which the invention is based is, therefore, to take measures by means of which the incorrect bands possibly extracted from the magazine are eliminated in a trouble-free manner.

To achieve this object, the process according to the invention is characterised in that, when several bands resting on top of one another are extracted at the same time, the upper or outer incorrect bands are removed by being displaced transversely and/or sucked off from the individual band to be fed to the pack.

Preferably, mechanical and pneumatic forces are exerted on the incorrect bands so that these are removed from the individual band held on the band-conveyor by means of suction air. During this operation, the gripper, provided likewise in the invention, or any other mechanical fixing for the bands is moved out of engagement. This operation of eliminating incorrect bands takes place before the gluing of the individual band remaining on the band-conveyor.

So that the incorrect bands possibly present and eliminated do not stay in a disorderly fashion in the packaging machine, according to a further proposal of the invention the incorrect bands removed are conveyed away, especially sucked off in an orderly fashion.

The apparatus according to the invention for carrying out the process is equipped with a suction conveyor, namely a conveyor belt which rests against the outer side of the incorrect bands on the band-conveyor and which is preferably equipped with suction holes. The purpose of this conveyor belt (suction belt) is first, as a result of rotary movement relative to the incorrect bands, especially counter to the conveying direction of these, to detach them from the individual band remaining on the band-conveyor and fixed by means of suction air. After that or at the same time, these incorrect bands are grasped by means of suction air and are conveyed away by means of a suction bell extending over the band-carrier and having an adjoining suction channel.

Further features of the invention relate to the design of the device for conveying away the incorrect bands and to the design of the band-conveyor.

Figure 2:
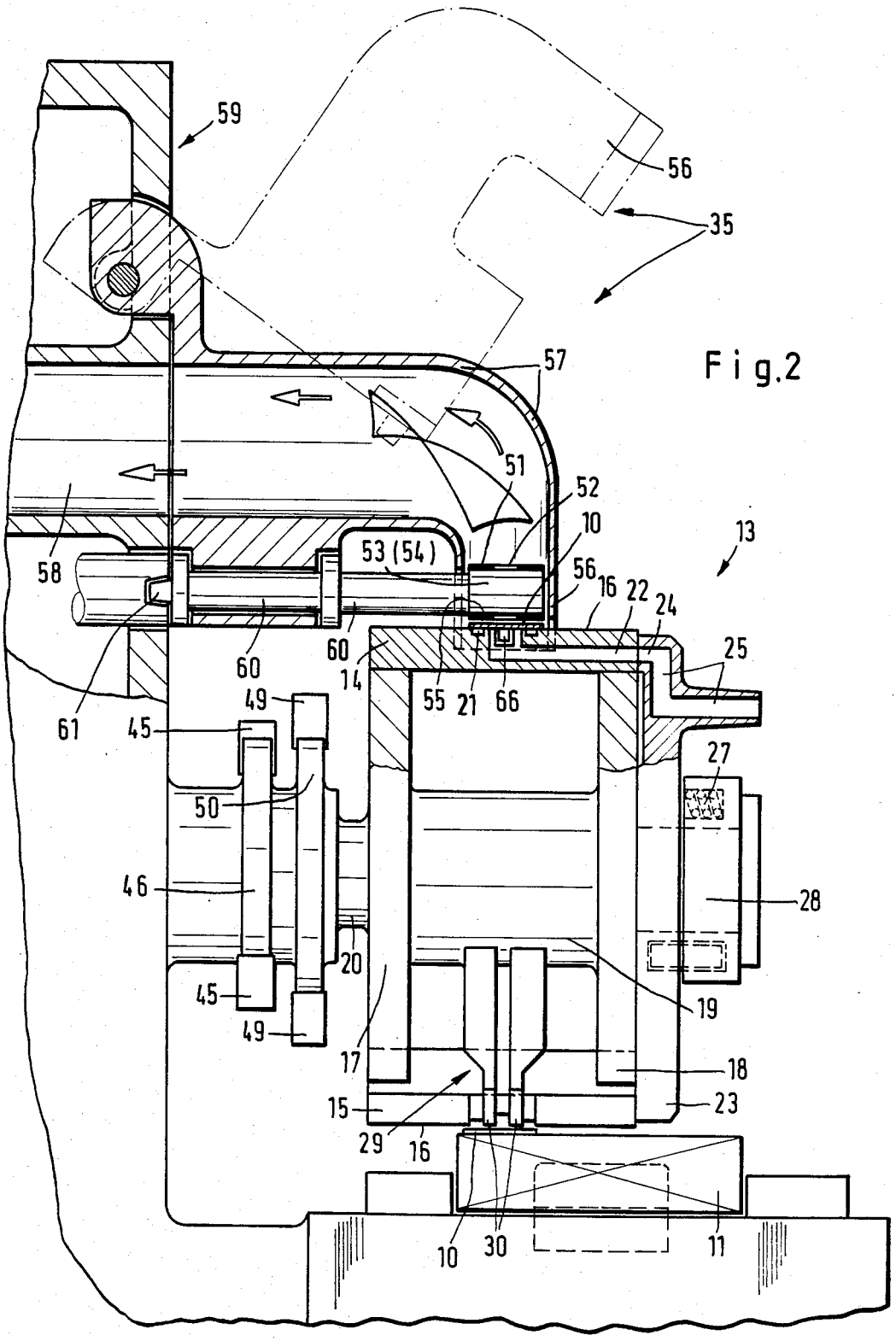
Figure 3:
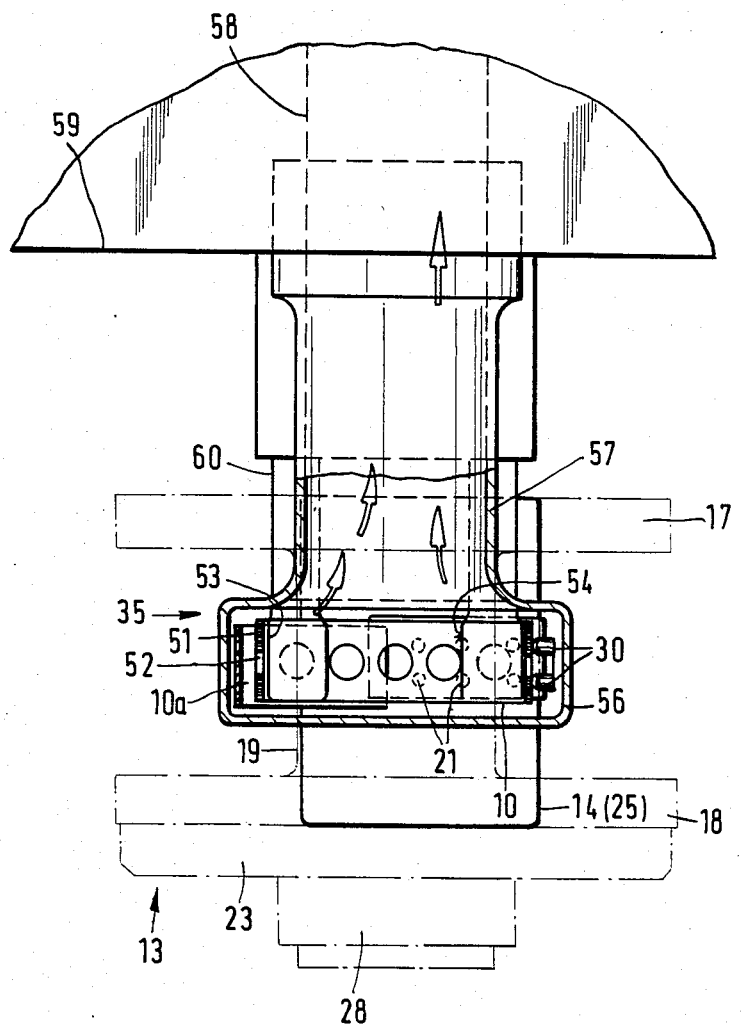
Figure 4:
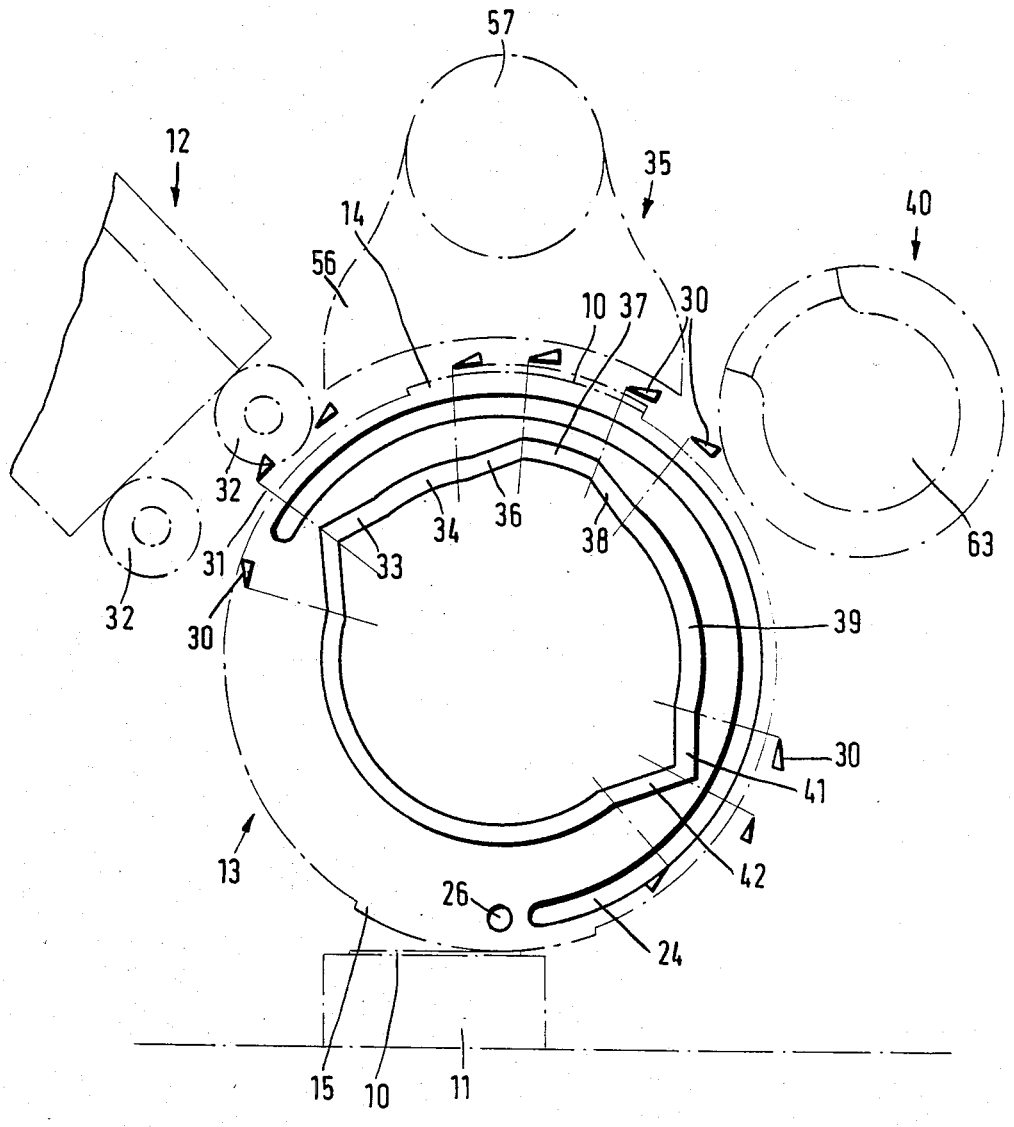

An exemplary embodiment of the invention is explained in more detail below with reference to the drawings in which:

FIG. 1 shows the apparatus for feeding bands to a pack, in a diagrammatic side view, partially in a vertical section, FIG. 2 shows a view of the apparatus according to FIG. 1, offset 90°, likewise partially in a vertical section, FIG. 3 shows a detail of the apparatus according to FIGS. 1 and 2, in particular a horizontal section in the region where incorrect bands are sucked off, FIG. 4 shows a control diagram for a gripper assigned to the band-carrier.

The exemplary embodiment illustrated in the drawings show the preferred sector of application, namely the feeding of (revenue) bands 10 to a (cigarette) pack 11. The bands 10 are extracted individually from a magazine 12 with a plurality of stacked bands 10, are conveyed along a partial circular arc by a revolving band-conveyor 13 and are applied in the lower region to the top side of the pack 11.

In the present exemplary embodiment, the band-conveyor 13 is equipped with two band-carriers 14, 15 which are located diametrically opposite one another and which each receive a band on the outer contact surface 16 curved in the form of a circular arc. The segment-like band-carriers 14, 15 are connected to the outer periphery of supporting discs 17 and 18 located respectively on the end faces of the band-conveyor 13. The supporting discs 17, 18 rest in turn, on a hub 19 which connects them to one another and which is mounted on a shaft 20 for driving the band-conveyor 13.

The band-carriers 14, 15 are subjected to suction air for the purpose of retaining the bands 10. In the present exemplary embodiment, a group of suction bores 21 opens into a region of the band-carrier 14,15, or on the contact surface 16 of the latter, located at the front in the direction of transport. The suction bores 21 arranged at a distance from one another are connected to a common transverse suction channel 22. This opens onto an outer side face of the band-carrier 14, 15. Formed in a fixed control disc 23 is a control groove 24 in the form of a circular arc, which is open towards the band-carrier 14, 15 or towards the suction channel 22. This control groove is, in turn, subjected to suction air from a vacuum source by means of a connecting channel 25. That conveying region in which the band-carriers 14, 15 are subjected to suction air is fixed by means of the position and length of the control groove 24. To make it easier to transfer the band 10 to the pack 11, a vent bore 26 is formed here in the control disc 23, so that the holding force exerted by the suction air on the bands 10 is eliminated at this point. The fixed control disc 23 is pressed elastically, particularly by means of springs 27 in a stop disc 28, against the side faces of the band-carriers 14, 15.

A gripper 29 with two clamping jaws 30 is assigned to each band-carrier 14, 15 as a further holding member for the bands 10. The gripper 29 is arranged in relation to the particular band-carrier 14, 15 so that in the closing position the clamping jaws 30 grasp the edge region of the band-carrier 14, 15 or of the contact surface 16 located at the front in the direction of the transport. The front edge of the band 10, which terminates essentially flush with the contact surface 16 in this region, is thus clamped against the band-carrier 14, 15.

During a revolving movement of the band-carrier 14, 15, the gripper 29 executes a complex movement. This is illustrated diagrammatically in the diagram of FIG. 4.

In the receiving position 31, the gripper 29 is in the position of readiness, but the clamping jaws 30 are opened. As a result, a band 10 can be transferred from the magazine 12 to the particular band-carrier 14, 15. This feed is carried out by means of a roll-off device 32 of known construction and operation. The gripper 29 then passes (together with the band-carrier (14, 15) through a closing phase 33 and then a clamping portion 34. This is followed, in the region of a suction unit 35 for incorrect bands 10*a*, 10*b*, etc., first by an opening phase 36 and then by a portion 37 where the gripper 29 is open. During this portion 37, incorrect bands 10*a*, 10*b*, etc. are eliminated in a way yet to be described.

This is followed, again, by a closing phase 38 and a clamping portion 39. In this region, the band 10 is provided on its outer side with glue by a gluing appliance 40. After the longer clamping portion 39 has ended, a new opening phase 41 takes place, and adjoining this a region 42 in which the entire gripper 29 is moved away inwards by means of an appropriate movement, so that during transfer of the band 10 to the pack 11 the gripper 29 cannot cause any disturbances (FIG. 1 bottom left). The gripper 29 is moved back from this retracted position before the start of the closing phase 33.

In the present exemplary embodiment, the gripper 29 is designed as a two-armed lever with a central pivot bearing 43. One lever arm is formed by the clamping jaws 30, whilst the other lever arm runs, as a control arm 44 with a control roller 45, on a fixed cam disc 46. The design of this cam disc 46 is chosen so that the opening and closing movements of the clamping jaws 30 are executed as a result of appropriate pivoting movements of the gripper 29.

There engages in the region of the pivot bearing 43 a further pivoting arm 47, the free end of which is anchored in a fixed pivot bearing 48 on the revolving band-conveyor 13. By means of the pivoting arm 47, the gripper 29 or a further control roller 49 located in the pivot bearing 43 of the latter is pressed against a second cam disc 50. Together with the cam disc 46, this causes such a movement that in the region where the band 10 is transferred to the pack 11 the gripper 29 is drawn back as a whole into the interior of the band-conveyor 13.

When bands 10 are transferred from the magazine 12 to a band-carrier 14, 15, it is not possible to prevent several bands 10 adhering to one another from being extracted from the magazine 12 at the same time and transferred to the band-carrier 14, 15. These incorrect bands 10*a*, 10*b*, etc. are removed from the band-carrier 14, 15 immediately following the magazine 12, so that subsequently only a single band 10 is conveyed further. For this purpose, a suction unit 35 is located in the upper region, located approximately opposite the transfer of the band to the pack. This suction unit consists of several members for detaching the incorrect bands 10*a*, 10*b*, etc. and for conveying them away.

A mechanical member, in particular a suction belt 51, serves for detaching the incorrect bands 10*a*, 10*b*, etc. from the band 10 to be conveyed further. This is a conveyor belt which is designed with suction holes 52 and which runs over deflecting rollers 53, 54. In the present exemplary embodiment, of these the deflecting roller 53 is driven. The suction belt 51 is driven counter to the conveying direction of the band-carriers 14, 15. The relative position is chosen so that a working side 55 assigned to the band-carrier 14, 15 rests, curved arcuately, against the outer band 10 or 10*a*, 10*b*, etc. The surface of the suction belt 51 is designed with a relatively high coefficient of friction, so that the incorrect bands 10*a*, 10*b*, etc. not specially fixed to the band-carrier 14, 15 are detached as a result of transverse displacement from the band 10 resting directly against the contact surface 16. When there are several incorrect bands 10*a*, 10*b*, etc., they are pushed off backwards like flakes by the suction belt 51 (FIG. 3). When the gripper 29 is opened, the band 10 to be conveyed further is retained on the band-carrier 14, 15 by means of the suction bores 21.

The incorrect bands 10*a*, 10*b*, etc. detached from the band-carrier 14, 15 and displaced sideways in the way described above are then removed, specifically by means of suction air. For this purpose, the suction unit 35 is equipped with a suction belt 56, particularly a vessel open downwards, which, widening in the manner of a bell, extends over the suction belt, matching the curvature of the band-conveyor 13. The suction bell 56 is connected to a vacuum source, specifically, in the present case, via a suction tube 57 guided essentially horizontally as a result of deflection. This receives the incorrect bands 10*a*, 10*b*, etc. sucked off and conveys them via an adjoining conveying tube 58 to a suitable collecting point. In the lower region adjacent to the suction belt 51, the suction bell 56 is made distinctly larger, particularly wider in a peripheral direction, than the suction belt 51 is long. This guarantees that the incorrect bands 10*a*, 10*b*, etc. detached from the suction belt 51 are conveyed away in an orderly fashion. Moreover, the suction air also passes through the suction holes 52.

The suction bell 56, together with the adjoining suction tube 57, is mounted removably or pivotably on a supporting frame 59 which also receives the conveying tube 58. It is thereby possible to lift off the suction part, namely the suction bell 56 and suction tube 57, as a whole from the band-conveyor 13, specifically together with the suction belt 51. A drive shaft 60 for the suction belt 51 is subdivided for this purpose and is equipped with a claw clutch 61. The part of the drive shaft 60 facing the suction belt 51 can consequently also be swung off.

The gluing appliance 50 shown merely diagrammatically can be designed in a conventional way, namely with a glue vessel (not shown), a transfer roller 62 and a gluing segment 63. The latter transfers the particular glue pattern desired to the outer side of the band 10.

To detach the band 10 safely from the band-carrier 14, 15 and transfer it to the pack 11 supplied on a pack track 64, an elongate finger-like lifting-off device 65 is attached fixedly in this lower region. It penetrates into a central annular groove 66 on the outer side of the band-carriers 14, 15 so that as a result of the relative movement the band 10 is lifted off from the contact surface 16.

I claim:

1. A method for feeding sheet shaped blanks to an article comprising the following method steps:

extracting the said blanks from a magazine (12) at a first point, if more than one blank is erroneously extracted, together they comprise a lowest blank (10) and an upper erroneous blank or blanks, holding said blanks to a blank-conveyor (13) by a first suction means and a mechanical means, conveying the blanks in a first direction to a second point, at the second point, separating and lifting off the upper blanks resting on top of the lowest blank by laterally displacing, in a direction opposite to said first direction, said upper erroneous blanks and removing said upper blanks from the lowest blank by suction applied in a direction transverse to the conveying direction of the blanks.

2. A method according to claim 1 further comprising the step of partially releasing momentarily the blanks from the blank-conveyor during the removal of said upper erroneous blanks.

3. A method according to claim 1 or 2 wherein said blanks are fixed to said blank-conveyor by both air suction and a mechanical force, and further comprising the step of releasing only said mechanical force during the separating and lifting off process of said upper erroneous blanks.

4. Apparatus for feeding individual sheet-shaped blanks to an article, comprising:

revolving blank conveyor means for extracting sheet-shaped blanks from a magazine located at a first point opposite the path of said conveyor means and for conveying said blanks in a first direction to a second, different point opposite said path;

means for holding said extracted blanks on said conveyor means; when more than one blank is extracted, the extracted blanks forming a stack of blanks with the lowest blanks in the stack being the blank to be fed to the article, and the remaining blanks in the stack being defined as upper blanks;

blank separating means located at said second point and comprising both a means for laterally displacing, in the direction opposite to said first direction, all upper blanks relative to said lowest blank and also first air suction means for separating by suction the displaced upper blanks from said lowest blank, and second air suction means for removing the separated upper blanks and transporting them to a collection point;

wherein said blank separating means comprises a revolving suction conveyor for separating said blanks by lateral displacement, said suction conveyor having a relatively high coefficient of friction and suction holes such that resting said suction conveyor on an upper blank causes said upper blanks to be separated and lifted off said lowest blank, said second air suction means comprising a vessel adjacent said blank conveyor means and opening downwards in the shape of a bell extending over said suction conveyor, said vessel including a suction tube for transporting the separated blanks to said collection point, said tube being oriented in a direction transverse to the conveying direction of the blanks.

5. Apparatus as in claim 4, further comprising a magazine storing a plurality of sheet-shaped blanks and having an open end at said first point for removal of said blanks, so that, when two or more blanks are removed, said lowest blank is held against the surface of said conveyor means.

6. Apparatus as in claim 4 or 5, said means for holding comprising a third suction means for holding said lowest blank to the surface of said blank conveyor means, and a mechanical gripper means for holding all of said blanks to said blank conveyor means.

7. Apparatus as in claim 6, said holding means having a front side in relation to the direction of rotation of said revolving blank conveyor, and said first air suction means having a group of suction bores located on said front side for holding said lower blank to said revolving blank conveyor.

8. Apparatus for feeding individual sheet-shaped blanks to an article, comprising:

revolving blank conveyor means for extracting sheet-shaped blanks from a magazine located at a first point opposite the path of said conveyor means and for conveying said blanks to a second, different point opposite said path;

means for holding said extracted blanks on said conveyor means; when more than one blank is extracted, the extracted blanks forming a stack of blanks with the lowest blank in the stack being the blank to be fed to the article, and the remaining blanks in the stack being defined as upper blanks;

blank separating means located at said second point and comprising both a means for laterally displacing all upper blanks relative to said lowest blank and also first air suction means for separating by suction the displaced upper blanks from said lowest blank, and second air suction means for removing the separated blanks and transporting them to a collection point;

said means for holding comprising a third suction means for holding said lowest blank to the surface of said blank conveyor means, and a mechanical gripper means for holding all of said blanks to said blank conveyor means;

said apparatus further including a means for partially canceling said holding means by moving said mechanical gripper out of engagement at said second point, thus allowing said separating means to separate and lift off said upper blanks from said lowest blank.

9. Apparatus as in claim 8, further comprising a magazine storing a plurality of sheet-shaped blanks and having an open end at said first point for removal of said blanks, so that, when two or more blanks are removed, said lowest blank is held against the surface of said conveyor means.

10. Apparatus for feeding individual sheet-shaped blanks to an article, comprising:

revolving blank conveyor means for extracting sheet-shaped blanks from a magazine located at a first point opposite the path of said conveyor means and for conveying said blanks to a second, different point opposite said path;

means for holding said extracted blanks on said conveyor means; when more than one blank is extracted, the extracted blanks forming a stack of blanks when the lowest blank in the stack being the blank to be fed to the article, and the remaining blanks in the stack being defined as upper blanks;

blank separating means located at said second point and comprising both a means for laterally displacing all upper blanks relative to said lowest blank and also first air suction means for separating by suction the displaced upper blanks from said lowest blank, and second air suction means for removing the separated blanks and transporting them to a collection point;

said blank separating means comprising a revolving suction conveyor for separating said blanks by lateral displacement, said suction conveyor having a relatively high coefficient of friction and suction holes such that resting said suction conveyor on an upper blank causes said upper blanks to be separated and lifted off said lowest blank, said second air suction means comprising a vessel adjacent said blank conveyor means and opening downwards in the shape of a bell extending over said suction conveyor, said vessel including a suction tube for transporting the separated blanks to said collection point, said tube being oriented in a direction transverse to the conveying direction of the blanks.

11. Apparatus as in claim 10, further comprising a magazine storing a plurality of sheet-shaped blanks and having an open end at said first point for removal of said blanks, so that, when two or more blanks are removed, said lowest blank is held against the surface of said conveyor means.

12. Apparatus as claimed in claim 10 or 11 further comprising a frame, and means for pivotably mounting said vessel on said frame so that said vessel can be pivoted away from said blank conveyor means.

* * * * *